United States Patent [19]

Lunde et al.

[11] 4,396,314

[45] Aug. 2, 1983

[54] CONNECTION UNIT FOR SECURING OFFSHORE STRUCTURES TO MARINE BOTTOM

[75] Inventors: Peter A. Lunde, Houston, Tex.; Richard H. Gunderson, Weybridge, England

[73] Assignee: Exxon Production Research Co., Houston, Tex.

[21] Appl. No.: 255,932

[22] Filed: Apr. 20, 1981

[51] Int. Cl.[3] ..... E02B 17/00

[52] U.S. Cl. ..... 405/202

[58] Field of Search ..... 405/195, 202, 204, 224; 166/339, 341, 343, 359

[56] References Cited

U.S. PATENT DOCUMENTS

| | | | |
|---|---|---|---|
| 3,522,709 | 8/1970 | Vilain . | |
| 3,551,005 | 12/1970 | Brun | 166/341 X |
| 3,766,582 | 10/1973 | Lloyd et al. . | |
| 3,961,490 | 6/1976 | Corgnet | 405/202 |
| 4,048,944 | 9/1977 | Corgnet . | |
| 4,199,275 | 4/1980 | Tuson | 405/195 |
| 4,199,847 | 4/1980 | Owens . | |
| 4,286,898 | 9/1981 | Stafford | 405/224 |

OTHER PUBLICATIONS

"Design, Fabrication, Installation and Operation of a Single Anchor Log [sic] Mooring (SALM) Tanker Terminal in 300 Feet of Water", Kiely et al., Paper No. OTC 2213, Presented at Offshore Technology Conference, Houston, Tex, May 5-8, 1975.

"Santa Barbara SALM-A Prototype Deepwater Production Riser and Floating Production System", Wolfram et al., Paper No. OTC 3143, Presented at Offshore Technology Conference, Houston, Tex, May 8-11, 1978.

"The First Yoke Mooring for a VLCC in the Open Ocean", Poranski et al., Paper No. OTC 3564, Presented at the Offshore Technology Conference, Houston, Tex., Apr. 30-May 3, 1979.

"Single Point Mooring System for Floating LNG Plant", Zubiate et al., *Ocean Industry,* Nov. 1978, pp. 75-78.

"A Floating Alternative in LNG Plants", Pomonik et al., *Offshore,* Dec. 1978, pp. 126-140.

"Production Riser Technology Moves into Deeper Water", Gunderson et al., *The Oils & Gas Journal,* Mar. 19, 1979, pp. 79-85.

"Deepwater Production Risers", Gunderson et al., ASME Publication No. 78-PET-13, Presented at the Engineering Technology Conference and Exhibition, Houston, Tex., Nov. 5-9, 1978.

"Exxon's New Deepwater Production Riser", Gunderson et al., *Ocean Industry,* Nov. 1978, Reprint.

"Tanker to Handle, Store Fulmar Oil", Matheny, Jr., *The Oil & Gas Journal,* May 5, 1980, pp. 226-234.

"Shell/Esso Takes Novel Approach to Speed Early Oil Flow on Fulmar", *Offshore Engineer,* May 1980, pp. 32-34.

"Shell/Esso Innovative In Fulmar Field", Bleakley, *Petroleum Engineer International,* Nov. 15, 1978, pp. 14-16.

"MK-EXTRA SALM-Project", *Metals and Chemicals* (Dutch Trade Journal), May 26, 1980, pp. 25-36, and Boele Bolnes Sales Brochure, Holland Fabrication Company.

*Primary Examiner*—David H. Corbin

*Attorney, Agent, or Firm*—K. C. Johnson; Marc L. Delflache

[57] ABSTRACT

A subsea connection unit for securing an offshore structure to a marine bottom is disclosed. The unit comprises a base adapted to be positioned on the marine bottom and an insert member adapted to be connected to the lower end of the offshore structure. The base has a recess thereon adapted to receive the insert member. Releasable vertical latch means comprised of a plurality of tapered shear blocks are carried by the insert member and cooperate with tapered lugs in the recess to lock the insert member against vertical movement within the recess. Releasable horizontal latch means comprised of a plurality of wedge members are positioned on the base around the recess and cooperate with load surfaces on the insert member to center and lock the insert member against horizontal movement within the recess.

11 Claims, 6 Drawing Figures

FIG. 3
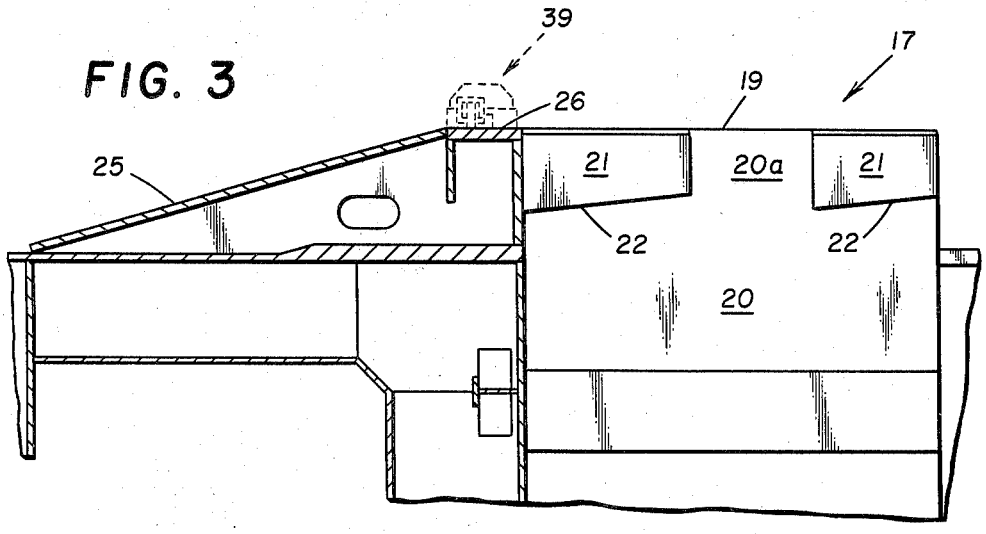
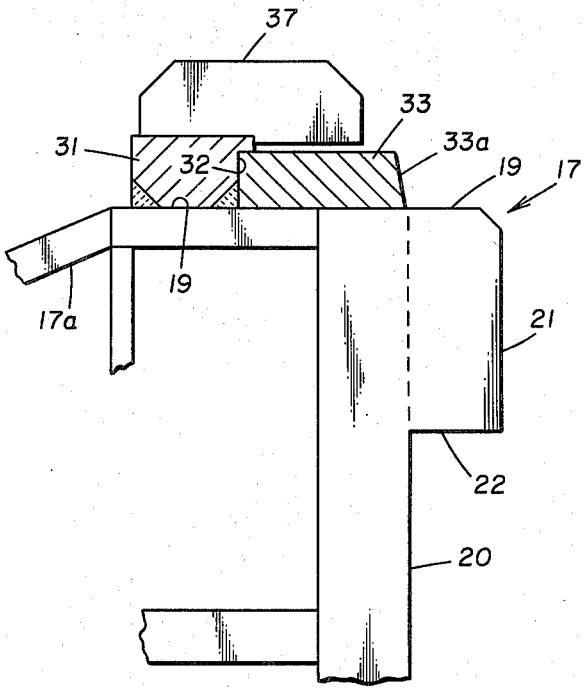
FIG. 4
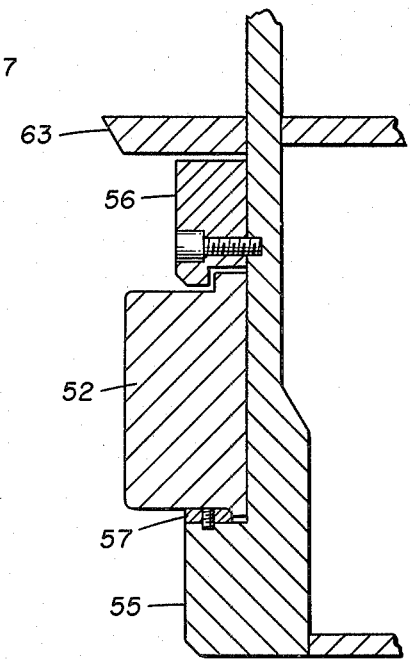
FIG. 6

CONNECTION UNIT FOR SECURING OFFSHORE STRUCTURES TO MARINE BOTTOM

DESCRIPTION

1. Technical Field

The present invention relates to a connection unit for securing an offshore structure to a marine bottom and, more particularly, relates to a subsea connection unit having a latching system for releasably securing an offshore structure to a base structure which, in turn, is positioned on the marine bottom.

2. Background Art

In the marine production or transportation of hydrocarbons and related products, it is now commonplace to use an offshore terminal to load hydrocarbons on and off sea-going tankers. One group of such offshore terminals is occasionally referred to as single anchor leg moorings (SALM). A typical SALM is comprised of a base structure which is positioned on the marine bottom and a riser element which is connected to the base structure. The riser normally has a universal joint, or equivalent structure, at its lower end which allows the riser to rotate about two separate axes with respect to the base. The riser extends upward from the base to a point at or near the water's surface and is supported in a substantially vertical position by means of attached buoys or buoyant chambers within the riser itself. The upper end of the riser normally includes a mooring turntable which permits a tanker to weathervane around the riser during on-loading or off-loading operations. Flowlines extend from the marine bottom, along the riser, and through multiline fluid swivels situated on the mooring turntable. These flowlines provide conduits through which fluids are loaded on and off the tanker.

In installing a typical SALM, the base structure is normally first fixed to the marine bottom by filling chambers in the base with high density ballast material or by setting piles through sleeves on the base. The riser is then lowered and a universal joint, which is on the lower end of the riser, is connected to the base.

Various means have been used or proposed for connecting the riser to the base. For example, by using divers, some risers are merely bolted to the base. This provides a good connection, but, in those instances where it becomes necessary to retrieve the riser and its universal joint due to in-service damage, equipment failure, or maintenance requirements, the disassembly of the multi-bolted connection is difficult, time consuming and dangerous.

Releasable latching mechanisms have also been used or proposed for connecting the riser to its base. Examples of such releasable latching mechanisms are disclosed and discussed in U.S. Pat. Nos. 3,522,709; 3,766,582; and 4,048,944 and in papers (1) DESIGN, FABRICATION, INSTALLATION, AND OPERATION OF A SINGLE ANCHOR LOG (sic) MOORING (SALM) TANKER TERMINAL IN 300 FEET OF WATER, Kiely et al, Paper No. OTC 2213, presented at Offshore Technology Conference, Houston, Tex., May 5–8, 1975 and (2) SANTA BARBARA SALM—A PROTOTYPE DEEPWATER PRODUCTION RISER AND FLOATING PRODUCTION SYSTEM, Wolfram et al, OTC 3143, presented at Offshore Technology Conference, Houston, Tex., May 8–11, 1978.

Each of these latching mechanisms provides a good vertical connection between the riser and its base. Each mechanism relies upon the actual contact between the respective mating surfaces of the riser and its base to prevent any lateral or horizontal movement between the two when they are assembled. This generally requires precision fabrication of both the base and the riser to insure that the tolerances between the respective mating surfaces do not wobble or have any horizontal play between the riser and the base.

DISCLOSURE OF INVENTION

The present invention provides a subsea connection unit for releasably securing an offshore structure, e.g. a SALM, to a base secured to the marine bottom. The connection unit comprises a base structure adapted to be secured to the marine bottom and an insert member adapted to be connected to the lower end of the offshore structure and further adapted to be releasably connected to the base. The present connection unit not only includes releasable latch means for securing the insert member against vertical movement with respect to the base but also includes releasable latch means for securing the insert member against horizontal movement with respect to said base. Further, the present invention provides a connection unit which allows a preload force greater than the encountered loads to be applied in making-up the insert member and the base thereby providing a direct load path between the offshore structure and the base. Vertical, horizontal, and/or overturning loads which may be encountered by the offshore structure are transmitted from the insert member to the base structure solely by direct bearing rather than by tension through latching pins or bolts or by shear of wedges attached to the top of the base.

Structurally, the present connection unit is comprised of a base which is adapted to be secured on the marine bottom and an insert member which is adapted to be connected to the lower end of the offshore structure (e.g. the riser element of a SALM). The base includes a recessed portion adapted to receive the insert member.

The connection unit includes releasable vertical latch means which coöperate between the insert member and the base to latch the insert member against vertical movement within the recessed portions. The vertical latch means comprise hydraulically-actuated, wedge elements which are movable into and out of contact with tapered lugs in the recessed portion so as to lock and release, respectively, the insert member in the recessed portion. Due to the wedging action between the tapered surfaces of the wedge elements and the lugs, a preload force is generated in locking the insert member within the base.

Although the outer periphery of the insert member conforms substantially to the shape of the recessed portion, precise tolerances between the two do not have to be rigorously maintained during fabrication since, in the present invention, releasable horizontal latch means are provided on the base which, when moved toward their latched positions, center and secure the insert member against horizontal movement within the recessed portion. The horizontal latch means comprise individual latch units which are positioned at each corner of the recessed portion. Each latch unit comprises a stationary wedge which is affixed to the base and a movable wedge which slides along the stationary wedge. Actuating means, e.g. hydraulic cylinders, displace the movable wedges along their respective stationary wedges thereby causing the movable wedges to move outward into contact with load surfaces on the insert member. Thus, the insert member is centered within the recessed portion and secured against horizontal movement, relative to the recessed portion.

Once both the vertical and horizontal latch means are in their latched positions, each may be locked in said latched position by, for example, welding either the respective wedges together in their latched position or the movable wedges to the base structure in their latched position, inserting lock pins or the like through the rods of the actuating hydraulic cylinders; circulating epoxy into the hydraulic cylinders used to actuate the latch means to replace the hydraulic fluid therein, etc. The epoxy fills the cylinder and is allowed to harden to prevent the piston and rod from retracting into the cylinder. When the need arises to release the latch means to retrieve the riser element, the welds may be cut, lock pins removed, or the epoxy-filled cylinders on both the vertical and horizontal latch means replaced, after which both the vertical and horizontal latch means are retracted to free the insert member from the recessed portion.

BRIEF DESCRIPTION OF THE DRAWINGS

The present invention will be better understood by referring to the drawings in which like numerals identify like parts and in which:

FIG. 3 is an enlarged cross-sectional view taken along line 3—3 of FIG. 1;

FIG. 4 is an enlarged cross-sectional view taken along line 4—4 of FIG. 2;

FIG. 6 is an enlarged cross-sectional view taken along line 6—6 of FIG. 5.

BEST MODE FOR CARRYING OUT THE INVENTION

Figure 1:
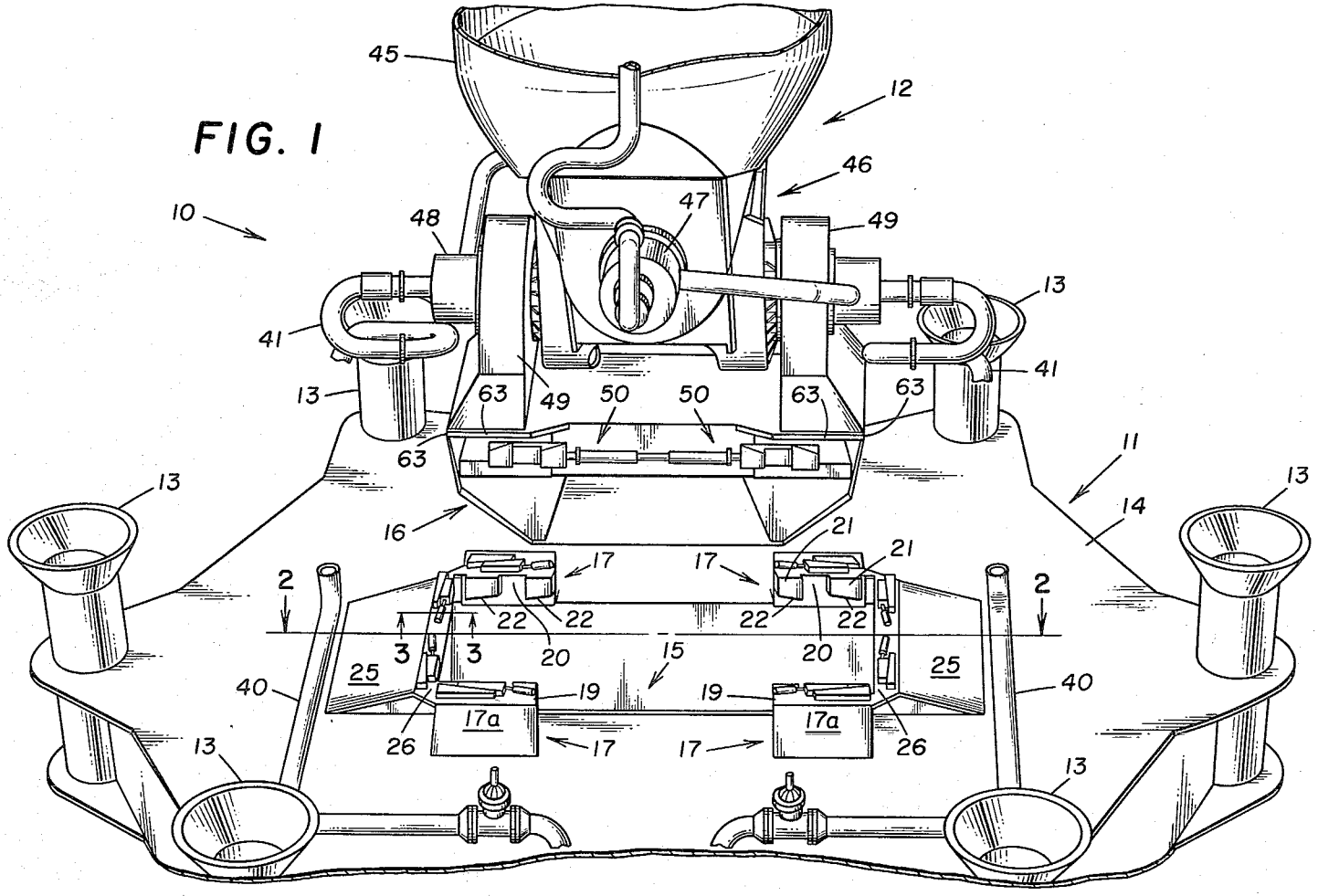
FIG. 1 is a perspective view, partly broken away, of the subsea connection unit of the present invention with the insert member and the base structure in a disassembled position.

FIG. 1 discloses subsea connection unit 10 for securing an offshore structure 12 to a marine bottom (not shown). Unit 10 is comprised of base structure 11 and insert member 16. Unit 10 is connected to the lower end of offshore structure 12. As illustrated, base structure 11 is adapted to be affixed to the marine bottom by setting piles (not shown) into the marine bottom through guide sleeves 13 which are spaced about a platform 14 of base 11. It should be recognized that other means (e.g. filling chambers in base 11 with ballast material) could be used to secure base 11 on the marine bottom without departing from the present invention.

As illustrated, offshore structure 12 comprises the riser element of an offshore terminal, e.g. a single anchor leg mooring system (SALM). For a more complete description of the entire structure and operation of a typical SALM, see SANTA BARBARA SALM—A PROTOTYPE DEEPWATER PRODUCTION RISER AND FLOATING PRODUCTION SYSTEM, Wolfram et al, OTC 3143, presented at Offshore Technology Conference, Houston, Tex., May 8–11, 1978, and which is incorporated herein by reference. It should be recognized, however, that the present connection unit 10 can also be used to secure other similar-type offshore structures to a base structure on a marine bottom.

Offshore structure 12 is comprised of a cylindrical support leg 45 (shown broken away in FIG. 1) which has a universal joint 46 secured to the lower end thereon. As understood in the art, universal joint 46 has two axles 47, 48 which allows leg 45 to rotate about two different axes. Axle 48 is journaled in pillow blocks 49 which, in turn, are mounted on insert member 16. Flowlines 41 are provided through universal joint 46 and are adapted to be connected to complementary flowlines 40 on base 11 when offshore structure 12 is assembled onto base 11.

Figure 2:
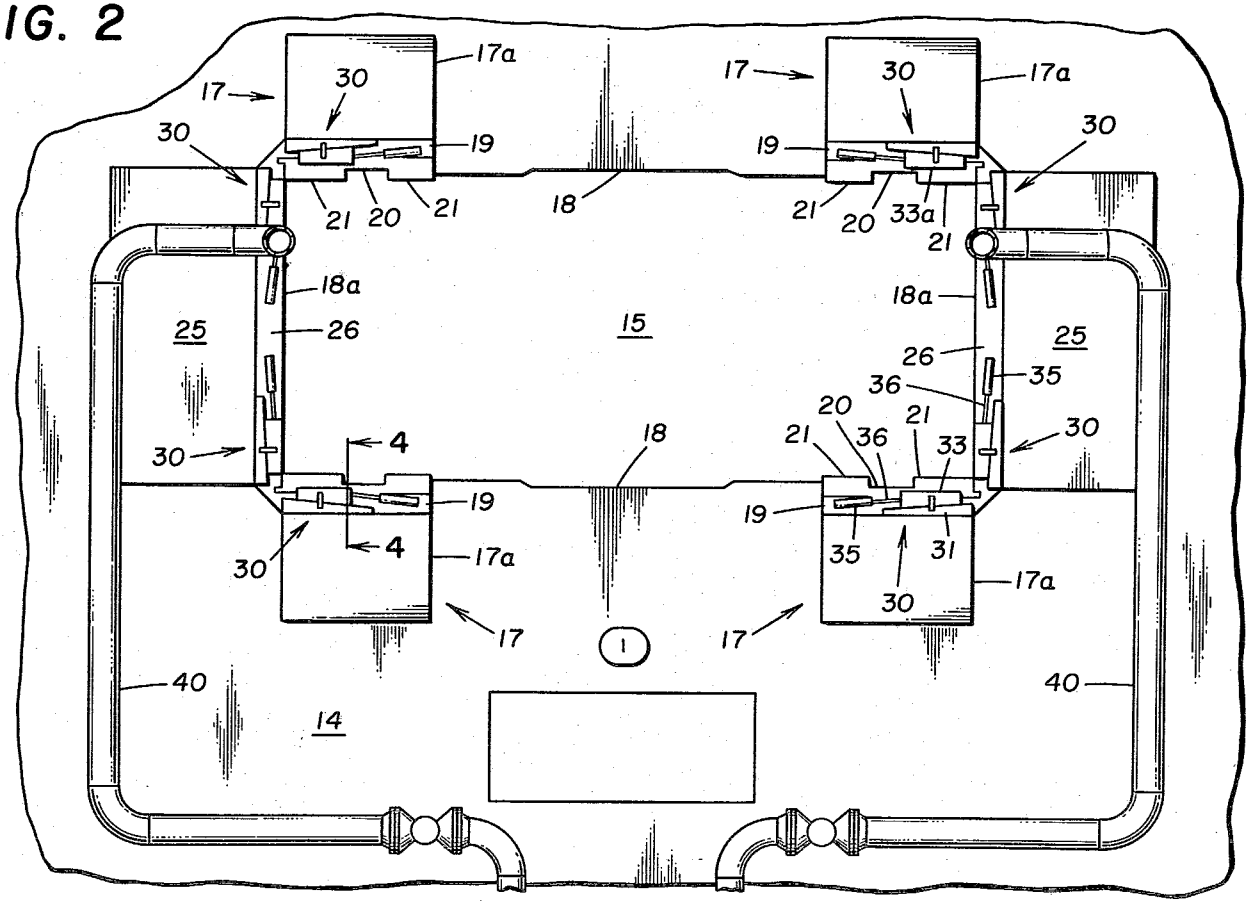
FIG. 2 is a plan view of the base structure, partly broken away, looking down from line 2—2 of FIG. 1.

Platform 14 of base 11 has a rectangular-shaped recessed portion 15 (also referred to as the "recess") thereon which is adapted to receive insert member 16. Affixed to platform 14 are four basically identical support members 17. One support member 17 is positioned at each end of opposite sides 18 of recess 15 as shown in FIG. 2. Each support member 17 is comprised of an angular support **17*a* which has an upper surface 19 and an inner surface 20. Each support member 17 is positioned so that its respective inner surface 20 substantially aligns wih side 18 of recess 15. Provided on inner surface 20 of each support 17 are two spaced lugs 21 having tapered lower surfaces 22 thereon (see FIG. 3**) for a purpose described below.

Also affixed to platform 14 and lying along each end **18*a* of recess 15 are basically identical, angular support members 25 (see FIGS. 1 and 2). Each support member 25 has an upper surface 26 thereon which is level with upper surfaces 19 of support members 17. Mounted on the upper surfaces 19, 26, of support members 17, 25, respectively, are eight basically identical, horizontal latch means 30 which are positioned so that there are two latch means 30 positioned substantially perpendicularly to each other, at each corner of recess 15 (see FIG. 2**).

Each horizontal latch means 30 is comprised of a stationary wedge 31 which is affixed to its respective upper surface 19, 26. Slidably positioned in slot 32 of wedge 31 (see FIG. 4) is a movable wedge 33. Actuating means, e.g. individual hydraulic cylinders 35 and associated rods 36 (see FIG. 2), are mounted on their respective upper surfaces 19, 26 for moving wedges 33 between their latched and unlatched positions. Removable pins (not shown) are used to secure cylinders 35 to surfaces 19, 26 and to secure rods 36 to their respective wedges 33, so that a cylinder 35 and its rod 36 can be easily and quickly replaced when the need arises. Guide plate 37 (see FIG. 4) is attached to stationary wedge 31 and extends over movable wedge 33 to aid in guiding and maintaining wedge 33 in a horizontal position on its respective upper surface during movement. Guide plate 37 also serves to assist in orienting the insert member 16 within the recess 15 and helps to prevent damage to the wedge 33 due to contact with the insert member 16.

The periphery of insert member 16 cnforms generally with the internal rectangular configuration of recess 15 but as will be explained in more detail later, the matching surfaces on insert member 16 and recess 15 do not have to be constructed within extreme tolerances with respect to each other since any lateral or horizontal play that may exist between these two elements when assembled will be compensated for and eliminated by horizontal latch means 30.

Figure 5:
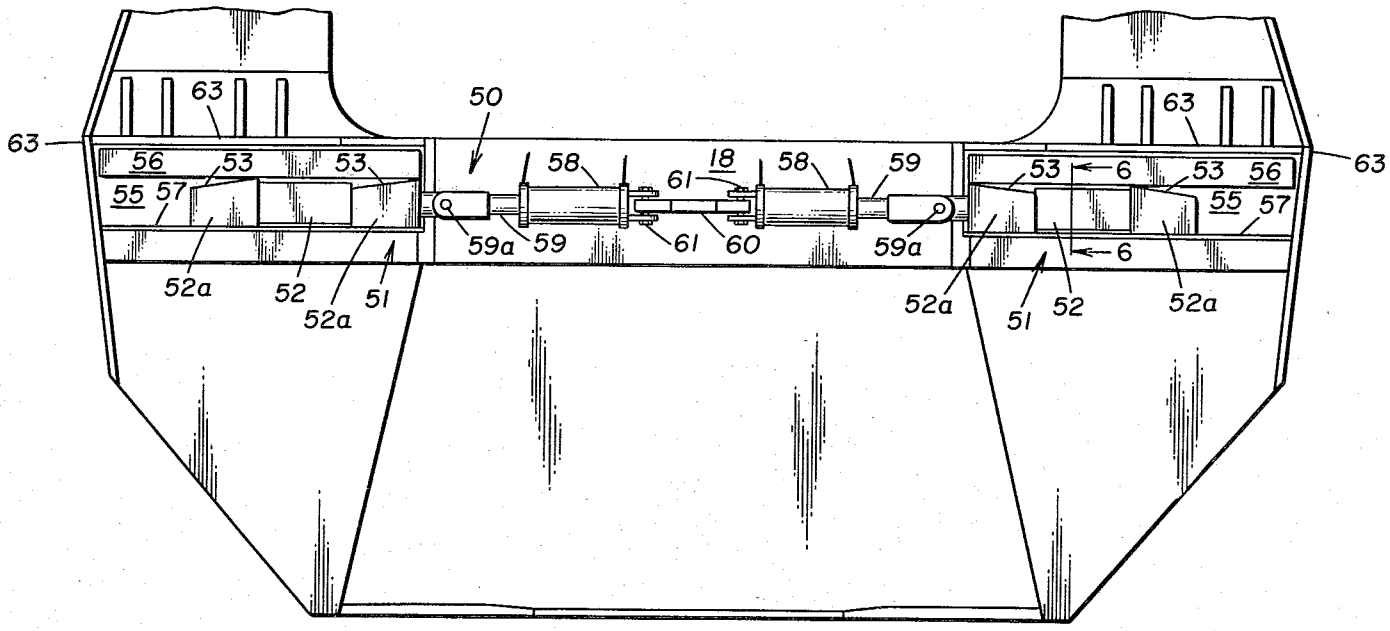
FIG. 5 is an elevational view, partly broken away, of the insert member of the present invention.

Mounted on insert member 16 are vertical latch means 50 (see FIG. 5). As illustrated, each vertical latch means 50 is comprised of a vertical latch unit 51. Two latch units 51 are positioned on each side 18 of insert member 16 (see FIG. 5) so that one vertical latch unit 51 will cooperate with lugs 21 of one support member 17 when insert member 16 is received in recess 15.

Each latch unit 51 is comprised of a wedge element 52 having two, spaced shear blocks 52*a* thereon. Each shear block 52*a* has an upper tapered surface 53 which conforms to a corresponding tapered surface 22 on a respective lug 21 (see FIG. 3). Wedge element 52 is mounted for slidable movement on the side 55 of insert member 16 and is held in position by an upper retainer plate 56 and a lower retainer 57 (see FIG. 6). An actuating means, e.g. hydraulic cylinder 58 having a piston rod 59, is connected to each wedge element 52 by removable pins 59*a*. As shown in FIG. 5, two hydraulic cylinders 58 on each side of insert member 16 are held in position by link 60 which is attached to insert member 16 and secured to the rear of each cylinder 58 by removable pins 61. Thus, cylinders 58 and rods 59 can easily be removed and replaced for a purpose described below. The insert member 16 includes load surfaces 63 (see FIGS. 1, 5, 6) which cooperate with horizontal latch means 30 as described below.

In operation, base structure 11 is secured to a marine bottom by drilling or driving piles (not shown) through sleeves 13 into the marine bottom. When base 11 is lowered and affixed to the marine bottom, each horizontal latch means 30 is in its retracted or unlatched position, i.e. rods 36, attached to movable wedges 33, are fully retracted within their respective hydraulic cylinders 35. Lines (not shown) for operating cylinders 35 and/or other controls on base 11 can be attached and lowered with base 11 or they may be attached by divers or the like after the base is positioned on the marine bottom.

By techniques well known in the art, e.g. guidelines (not shown), riser 12 is lowered and insert member 16 is directed into recess 15 on base 11. It will be seen that outermost shear block 52*a* of each wedge element 52 of vertical latch means 50 will pass downward through a space 20*a* between its respective lugs 21 (see FIG. 3). When load surfaces 63 of insert member 16 comes to rest on upper surfaces 19, 26 of supports 17, 25, respectively, the tapered upper surfaces 53 of shear blocks 52*a* will lie substantially level with the tapered lower surfaces 22 of their respective lugs 21.

Vertical latch means 50 are then set by actuating hydraulic cylinders 58 to move tapered surfaces 53 of each shear block 52*a* into contact with its respective tapered surfaces 22 of lugs 21. The relative movement between the respective tapered surfaces snugs insert member 16 downward into recess 15 and locks it therein against vertical movement. Wedge elements 52 are preferably set to produce a force equal to or greater than the maximum tensile load which is to be experienced by connection unit 10 and are locked in position to secure insert member 16 to base 11. Wedge members 52 may be locked with relation to lugs 21 by various means, e.g. lock pins, welding, etc. The wedge members 52 may be locked by circulating out the hydraulic fluid from cylinders 58 and replacing the fluid with epoxy or the like. The epoxy is allowed to set which prevents rods 59 from retracting, and hence locks means 50 in their latched position. Of course, an epoxy-filled cylinder and its rod is easily replaced by divers or the like by removing pins 59*a* and 61.

After or simultaneous with the latching of vertical latch means 50, horizontal latch 30 is actuated. Rods 36 from hydraulic cylinders 35 move movable wedges 33 relative to stationary wedges 31 which cause wedges 33 to move out into contact with adjacent load surfaces 63 on insert member 16. Continued movement of wedges 33 will center insert member 16 and lock it against horizontal movement within recess 15. Wedges 33 are set with enough force to insure a tight fit between wedges 33 and load surfaces 63. After horizontal latch means 30 are set, they are locked in position in the same manner as described above with respect to vertical latch means 50. Surface 33*a* of each wedge 33 is preferably tapered as shown in FIG. 4 to cooperate with a correspondingly tapered load surface 63 (see FIG. 6) to thereby insure a tighter fit between the two surfaces which more effectively eliminates any horizontal play between insert member 16 and base 11. The orientation of the tapers on surfaces 33*a* and 63 also produces a slightly downward force on wedge 33 which helps retain it in place.

When assembled, vertical latch means 50 are the primary vertical and overturning tensile load carrying elements between base 11 and insert member 16. Tensile loads are transmitted in bearing from shear blocks 52*a* on insert member 16 to lugs 21 on base 11. Compressive forces due to overturning and preload are transmitted from the lower side of load surfaces 63 which bear directly on upper surfaces 19, 26 of supports 17, 25, respectively. The horizontal latch means 30 serve as the primary horizontal load carrying connection between the base 11 and insert member 16.

As can be seen from the above description, riser 12 can be rapidly attached to base 11 thereby reducing both the time required for installation and the risks involved in this operation. If the riser or universal joint 46 is damaged or needs to be retrieved for any reason, connection unit 10 allows rapid disconnection of riser 12 from base 11.

The present invention has been described in terms of a preferred embodiment. Modifications and alterations to this embodiment will be apparent to those skilled in the art in view of this disclosure. It is, therefore, intended that all such equivalent modifications and variations fall within the spirit and scope of the present invention as claimed.

What is claimed is:

1. A subsea connection unit for securing an offshore structure to a marine bottom, said unit comprising:
   - a base structure adapted to be positioned on the marine bottom, said base structure having a recess therein;
   - an insert member adapted to be connected to the lower end of the offshore structure and adapted to be received in said recess on said base structure;
   - first latch means cooperating between said base structure and said insert member for releasably locking said insert member against vertical movement with respect to said base structure; and
   - second latch means, independent from said first latch means, cooperating between said base structure and said insert member for releasably locking said insert member against horizontal movement with respect to said base structure; said first latch means and said second latch means each including means movable relative to both said base structure and said insert member.

2. The subsea connection unit of claim 1 wherein said first latch means comprises:

a plurality of lugs positioned adjacent and about said recess, each of said plurality of lugs having at least one tapered lower surface thereon;

a plurality of shear blocks slidably positioned adjacent and about said insert member, each of said shear blocks having at least one tapered upper surface adapted to engage said at least one tapered lower surface when said insert member is received in said recess and when said first latch means is in a latched position, and means on said insert member for moving said plurality of said shear blocks to and from said latched position.

3. The subsea connection unit of claim 2 wherein said means for moving said plurality of shear blocks comprises:

hydraulically-actuated means positioned adjacent and about said insert member, and means for connecting said hydraulically-actuated means to said plurality of shear blocks.

4. The subsea connection unit of claim 1 wherein said second latch means comprises:

a plurality of wedge elements slidably positioned adjacent and about said recess; and means for moving said wedge elements into contact with said insert member when said insert member is received in said recess.

5. The subsea connection unit of claim 2 wherein said second latch means comprises:

a plurality of wedge elements slidably positioned adjacent and about said recess; and means for moving said wedge elements into contact with said insert member when said insert member is received in said recess.

6. The subsea connection unit of claim 5 wherein said means for moving said plurality of wedge elements comprises:

hydraulically-actuated means positioned adjacent and about said recess; and means for connecting said hydraulically-actuated means to said plurality of wedge elements.

7. The subsea connection unit of claim 1 wherein said recess is substantially rectangular in configuration and wherein said insert member conforms substantially to said rectangular configuration of said recess and wherein said first latch means comprises:

a plurality of lugs affixed to opposite sides of said recess, each of said plurality of lugs having at least one tapered lower surface thereon;

a plurality of shear blocks slidably positioned on opposite sides of said insert member, each of said shear blocks having at least one tapered upper surface adapted to engage said at least one tapered lower surface when said insert member is received in said recess and when said first latch means is in a latched position; and means on said insert member for moving said shear blocks to and from said latched position.

8. The subsea connection unit of claim 7 wherein said second latch means comprises:

a plurality of horizontal latch means positioned on said base adjacent said recess, each of said plurality of horizontal latch means comprising:

a stationary wedge element affixed to said base and having a first tapered surface thereon, a movable wedge element slidably positioned on said base and having a second tapered surface thereon which is in contact with said first tapered surface on said stationary wedge element, and means connected to said movable wedge element for moving said movable element relative to said stationary wedge element between latched and unlatched positions; and load surfaces on said insert member adapted to be engaged by said movable wedge elements when said insert member is received in said recess and said horizontal latch means are in a latched position.

9. The subsea connection unit of claim 8 wherein said means for moving said plurality of shear blocks comprises:

hydraulically-actuated means on said insert member; and means for connecting said hydraulically-actuated means to said plurality of shear blocks; and wherein said means for moving said plurality of wedge elements comprises:

hydraulically-actuated means on said base structure; and means for connecting said hydraulically-actuated means to said plurality of said wedge elements.

10. A single anchor leg mooring offshore structure comprising:

a riser element;

an insert member;

a universal joint connecting said insert member to the lower end of said riser element whereby said riser element can rotate about at least two axes with respect to said insert member;

a base structure positioned on the marine bottom, said base structure having a recess thereon into which said insert member is positioned;

first latch means cooperating between said base structure and said insert member for releasably locking said insert member against vertical movement within said recess; and second latch means, independent of said first latch means, cooperating between said base structure and said insert member for releasably locking said insert member against horizontal movement within said recess; said first latch means and said second latch means each including means movable relative to both said base structure and said insert member.

11. The single anchor leg mooring offshore structure of claim 10 wherein said first latch means comprises:

a plurality of lugs positioned adjacent and about said recess, each of said plurality of lugs having at least one tapered lower surface thereon;

a plurality of shear blocks slidably positioned adjacent and about said insert member, each of said shear blocks having at least one tapered upper surface adapted to engage said at least one tapered lower surface of a respective said lug when said insert member is received in said recess and when said first latch means is in a latched position; and means on said insert member for moving said plurality of said shear blocks to and from said latched position; and wherein said second latch means comprises:

a plurality of wedge elements slidably positioned adjacent and about said recess; and means for moving said wedge elements into contact with said insert member when said insert member is received in said recess to latch said insert member against horizontal movement within said recess.

* * * * *